United States Patent [19]

Kohyama

[11] Patent Number: 4,671,641

[45] Date of Patent: Jun. 9, 1987

[54] DEVELOPING APPARATUS

[75] Inventor: Mitsuaki Kohyama, Tokyo, Japan

[73] Assignee: Tokyo Shibaura Denki Kabushiki Kaisha, Kawasaki, Japan

[21] Appl. No.: 467,164

[22] Filed: Feb. 16, 1983

[30] Foreign Application Priority Data

Feb. 17, 1982 [JP] Japan ..... 57-24108
Feb. 17, 1982 [JP] Japan ..... 57-24109
Feb. 17, 1982 [JP] Japan ..... 57-24110

[51] Int. Cl.[4] ..... G03G 15/09

[52] U.S. Cl. ..... 355/3 DD; 355/14 D; 355/15; 430/122; 430/125

[58] Field of Search ..... 355/3 DD, 14 D, 15; 118/657, 652, 639; 430/122, 125

[56] References Cited

U.S. PATENT DOCUMENTS

| | | | |
|---|---|---|---|
| 3,909,258 | 9/1975 | Kotz | 118/658 X |
| 4,008,686 | 2/1977 | Katakura et al. | 355/3 DD X |
| 4,063,533 | 12/1977 | White | 118/658 |
| 4,162,842 | 7/1979 | Wu | 355/3 DD |
| 4,193,376 | 3/1980 | Hamaguchi et al. | 118/658 |
| 4,197,813 | 4/1980 | Yano et al. | 118/694 |
| 4,331,757 | 5/1982 | Tanaka et al. | 355/3 DD X |
| 4,384,545 | 5/1983 | Burnham et al. | 355/3 DD X |
| 4,430,957 | 2/1984 | Cherbuy et al. | 355/3 DD X |
| 4,436,055 | 3/1984 | Yamashita et al. | 355/3 DD X |

FOREIGN PATENT DOCUMENTS

| | | |
|---|---|---|
| 0024822 | 3/1981 | European Pat. Off. . |
| 0025671 | 3/1981 | European Pat. Off. . |
| 0028919 | 5/1981 | European Pat. Off. . |
| 55-144254 | 11/1980 | Japan . |
| 56-149071 | 11/1981 | Japan . |

OTHER PUBLICATIONS

European Patent Search No. 83101237.2, 1-16-84.

*Primary Examiner*—A. C. Prescott
*Attorney, Agent, or Firm*—Cushman, Darby & Cushman

[57] ABSTRACT

A developing apparatus is so set as to face the developed section of the electrostatic latent image-forming plane of the photosensitive drum, and causes a magnetic developing agent to be magnetically conducted to the electrostatic latent image-forming plane. Further, a magnet roll is so provided as to face that portion of the electrostatic latent image-forming plane of the photosensitive drum which has passed the developed region, thereby adsorptively removing the unnecessary particles of the developing agent which are deposited on the electrostatic latent image-forming plane. Therefore, the developing apparatus, though possessed of a relatively simple arrangement, has the advantages of suppressing the occurrence of the aforesaid tailing phenomenon, and enabling a distinct impression to be transcribed on a copy sheet with the reproducibility of fine lines prominently improved.

15 Claims, 11 Drawing Figures

DEVELOPING APPARATUS

BACKGROUND OF THE INVENTION

This invention relates to a developing apparatus for developing an electrostatic latent image, and more particularly to a developing device for developing an electrostatic latent image produced on a surface of a photosensitive layer by means of a magnetic developing agent.

In recent years, developments in an electrostatic photographic apparatus have largely been brought about by devices provided with a magnetic brush constituted of a one component magnetic toner used as a magnetic developing agent.

A typical electrostatic photographic apparatus is constructed, as shown in FIG. 1, by arranging a developing roll 16 which includes a magnet roll 12 having a plurality of magnetic poles so as to face an electrostatic latent image-forming plane (a developed plane) 10 of a photosensitive body and a cylindrical sleeve 14 surrounding the magnet roll 12.

The magnet roll 12 and cylindrical sleeve 14 are rotated in the opposite directions as indicated by the arrows given in FIG. 1, or in the same direction as shown in FIGS. 2 and 3, or the magnetic roll 12 alone is rotated, thereby providing a hollow cylindrical magnetic brush 20 formed of magnetic toner 18. Further, the cylindrical magnetic brush 20 is controlled to have a uniform wall thickness by a doctor blade 22. In other words, the conventional electrostatic photographic apparatus is the type in which the magnetic brush 20 is made to frictionally slide over the electrostatic latent image-forming plane 10 of the photosensitive body.

The above-mentioned prior art development process indeed assures an appreciably satisfactory picture quality. However, the process although retaining certain merits still has the following disadvantages. The development process of FIG. 1 indeed assures picture quality which is well balanced as a whole. However, the magnetic toner 18 which is deposited or is going to be deposited on the electrostatic latent image-forming plane 10 of the photosensitive body is rotated as a result of the rotation of a series of magnetic poles. Consequently, it is known that the solid image section of a developed latent image is accompanied, as shown in FIG. 4, at the rear or front end (as viewed in the traveling direction X of a copy sheet) with an unsatisfactory pattern commonly referred to as "tailing". The tailing appears, as shown by the reference numeral 24 of FIG. 4, in the form of, for example, a comet tail at the rear end of the solid image section 28 on a copy sheet 26.

Another drawback of the conventional development process is that an impression on the copy sheet 26 is accompanied with the phenomenon in which lines 30 of a developed latent image parallel with the traveling direction X of the copy sheet 26 are clearly impressed, whereas lines 32 of the developed latent image extending at right angles to the traveling direction X are indicated indistinctly. When, therefore, a graphed or pencil-written original impression is copied, an extremely unsatisfactory pattern arises. The reason why the aforementioned lines 32 extending across the traveling direction X of the copy sheet 26 become unclear is that the magnetic brush 20 formed of the magnetic toner 18 on the outer peripheral wall of the cylindrical sleeve 14 is rotated only in one direction, causing that magnetic toner 18 of lower adhesivity to the photosensitive body which forms the crosswise extending lines 32 to be partly scraped off by the rotation.

With the prior art development process of FIGS. 2 and 3, the hollow cylindrical sleeve 14 and magnet roll 12 are rotated in such a direction as offsets the traveling speed of the magnetic toner 18. As a result, the traveling speed of the magnetic toner 18 is retarded to reduce the force with which the impressed lines 32 are scratched off, improving the reproducibility (as counted among the various drawbacks accompanying the prior art development process of FIG. 1) of indistinct crosswise extending lines 32. However, the picture quality of an impression apprearing on the copy sheet 26 is rendered unsatisfactory due to the slow traveling speed of the magnetic toner 18. Where an insulative toner is used for the developing agent, specifically, the copy sheet cannot be put to practical use. Further, the problem of the aforementioned tailing phenomenon which accompanies the developed latent image due to the rotation of the magnetic roll 12 still remains unresolved.

Another development process has been proposed which carries out development by two developing rolls 16. This proposed development process, however, only ends with improvement in the density of an impression produced on a copy sheet, or in the reproducibility of the density of an original impression. To date, no developing apparatus has been proposed which can resolve all the drawbacks encountered in the past.

SUMMARY OF THE INVENTION

This invention provides a developing apparatus of simple arrangement which suppresses the occurrence of the so-called tailing phenomenon and enables the fine lines of an electrostatic latent image to be reproduced with great density and prominent distinction.

To attain the above-mentioned object, this invention provides a developing apparatus which is set to face the developed section of an electrostatic latent image-forming plane of a photosensitive body, and magnetically transfers a magnetic developing agent and supplies the magnetic developing agent to the electrostatic latent image-forming plane. Magnetic field generating means is provided to face the leading end of that portion of the electrostatic latent image-forming plane of the photosensitive drum which has contacted the cylindrical magnetic developing agent brush surrounding the developing roller, thereby preventing unnecessary developing agent which might otherwise result in the occurrence of the tailing phenomenon from remaining on the image-forming plane.

DETAILED DESCRIPTION OF THE PREFERRED EMBODIMENTS

Figure 5:
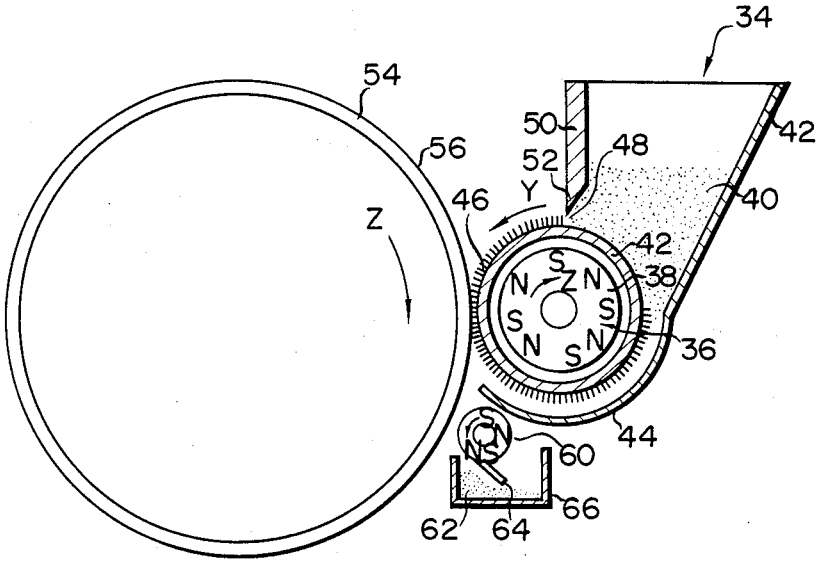
FIG. 5 is a sectional view of a first exemplary embodiment of a developing apparatus in accordance with the present invention.

Description will now given with reference to FIG. 5 of a first exemplary embodiment of a developing apparatus in accordance with the present invention. This developing apparatus 34 comprises a developing roll 36 which is provided with a magnet roll 38 having a plurality of magnetic poles and a hollow cylindrical sleeve 42 surrounding the magnet roll 38. The developing roll 36 is set in the body 44 of a developing apparatus communicating with a toner hopper 42A for holding magnetic toner 40 used as a magnetic developing agent. The magnet roll 38, a component of the developing roll 36, is rotated clockwise in the direction of arrow Z, and the cylindrical sleeve 42, another component of the developing roll 36, is rotated counterclockwise in the direction of arrow Y. Thus, a magnetic brush 46 of magnetic toner 40 is formed on the outer circumferential surface of the cylindrical sleeve 42. This magnetic brush 46 has its thickness controlled by a doctor blade 52 formed on the upper edge 50 of that opening 48 of the body 44 of the developing apparatus through which part of the developing roll 36 is exposed to the outside. The magnetic brush 46 is provided on the left side (FIG. 5) of the developing roll 36, which faces a photosensitive drum 54 to frictionally slide over the peripheral electrostatic latent image-forming plane 56 of the photosensitive drum 54. An electrostatic latent image previously produced on the electrostatic latent image-forming plane (developed plane) 56 of the photosensitive drum 54 is made to successively face charging means and latent image-producing means (neither shown) and has its surface rubbed by the magnetic brush 46 for development.

A cylindrical magnetic roll 60 having a plurality of magnetic poles is set below the body 44 of the developing apparatus, namely, downstream of the clockwise rotating photosensitive drum 54 in a state facing the already developed electrostatic latent image-forming plane 56 of the drum 54. The cylindrical magnetic roll 60 is spaced 0.3 to 1.0 mm from the electrostatic latent image-forming plane 56, has its magnetic flux density set at 600 to 1,000 gauss, and is designed to make several counterclockwise turns per minute.

Figure 1:
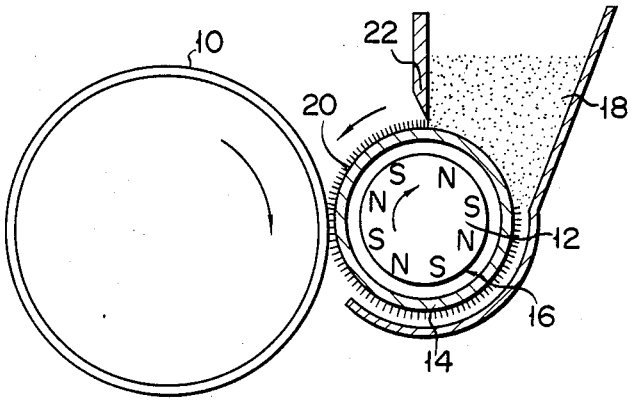
FIG. 1 PRIOR ART
FIG. 1 is a sectional view of a conventional developing apparatus.
Figure 2:
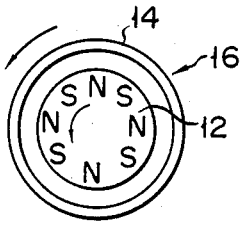
FIG. 2 PRIOR ART
FIGS. 2 and 3 are front views indicating the operation of a developing roller used with the conventional developing apparatus.
Figure 3:
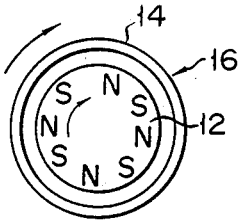
FIG. 3 PRIOR ART
Figure 4:
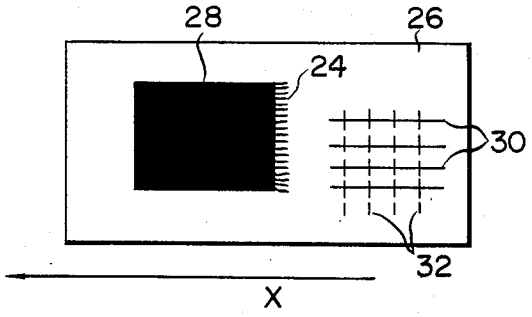
FIG. 4 PRIOR ART
FIG. 4 is a plan view of a copy sheet indicating drawbacks resulting from the application of the conventional developing apparatus.

The magnetic roll 60 generates a magnetic force to adsorptively remove the unnecessary particles of toner 62 retained on the electrostatic image-forming plane 56 which might othewise give rise to the tailing phenomenon 24 of FIG. 4. No electrostatic latent image is originally formed on that portion of the peripheral surface of the photosensitive drum 54 on which the unnecessary toner 62 is deposited. Therefore, the unnecessary toner 62 which is attached to the peripheral wall of the photosensitive drum 54 with low adhesivity can be adsorptively removed by the magnetic force of the magnetic roll 60. On the other hand, that section of the peripheral wall of the photosensitive drum 54 on which a latent image is electrostatically produced is covered with the magnetic toner 40 with too high adhesivity to be taken off by the magnetic force of the magnetic roll 60. As a result, the developing apparatus of this invention has the advantages of selectively eliminating not only the unnecessary toner 62 giving rise to the aforementioned tailing phenomenon but also fogging and blurring, and consequently prominently improving the picture quality of the whole impression transcribed on a copy sheet.

A blade 64 contacting the peripheral wall of the magnetic roll 60 scrapes off the unnecessary toner 62 adsorbed to the peripheral wall thereof. Therefore, the magnetic roll 60 is so designed as to cause the unnecessary toner 62 retained thereon to be removed under a specified condition. The unnecessary toner 62 removed by the blade 64 is collected in a receptacle 66.

The above-mentioned advantageous effect of the magnet roll 60 becomes more prominent, as a stronger magnetic force is applied to the electrostatic latent image-forming plane 56 of the photosensitive drum 54. It is possible to space the blade 64 from the magnet roll 60 at a distance of about 0.3 to 1.0 mm, thereby producing a magnetic brush from the unnecessary toner particles 62 on the peripheral wall of the magnetic roll 60. When the magnetic brush is made to frictionally slide over the electrostatic latent image-forming plane 56 of the photosensitive drum 54, then the unnecessary toner particles 62 can be more effectively taken off the photosensitive drum 54. Unless, however, the magnetic roll 60 is rotated several hundred times per minute in this case, an impression transcribed on a copy sheet tends to be contaminated by irregularities. Generally speaking, it is advised to apply the magnetic brush on the magnetic roll 60 in a state detached from the photosensitive drum 54. This arrangement assures good results.

Since the occurrence of the tailing phenomenon, fogging and blurring has been reduced as described above, the length of time required for projection of light beams to produce an electrostatic latent image can be decreased by 10 to 15% from that which has been used in the past. This means that the developing apparatus of this invention enables a latent image to be produced with a smaller loss of electric energy than is the case with the conventional developing apparatus. Consequently, the fine lines 32 of FIG. 4 extending across the traveling direction X of a copy sheet which hitherto presented difficulties in reproducibility can be prevented from being scraped off by the frictional sliding of the developing roll 36 due to the increased Coulomb force of the magnetic toner 40, and higher reproducibility is assured.

As described above, a developing apparatus according to a first embodiment of this invention is so set as to face the developed section of the electrostatic latent image-forming plane of the photosensitive drum 54, and causes a magnetic developing agent to be magnetically conducted to the electrostatic latent image-forming plane. Further, a magnetic member (magnet roll) is so provided as to face that portion of the electrostatic latent image-forming plane of the photosensitive drum which has passed the developed region, thereby adsorptively removing the unnecessary particles of the developing agent which are deposited on the electrostatic latent image-forming plane. Therefore, the first embodiment of this invention, though possessed of a relatively simple arrangement, has the advantages of suppressing the occurrence of the aforesaid tailing phenomenon, and enabling a distinct impression to be transcribed on a copy sheet with the reproducibility of fine lines prominently improved.

It will be noted that this invention is not limited to the first embodiment, but can be practiced with various modifications and changes without departing from the object of the invention.

Figure 6:
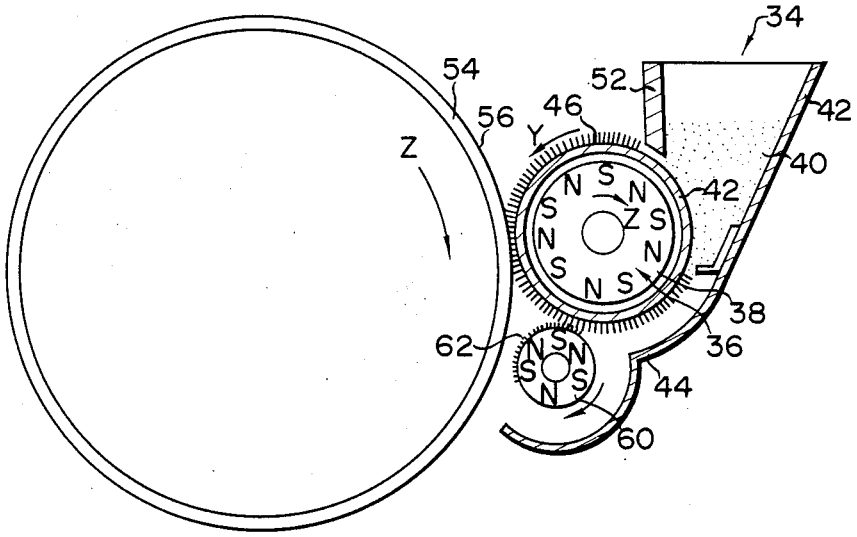
FIG. 6 is a sectional view of a first modification of the developing apparatus according to said first embodiment.

For instance, the invention may be improved as shown by a first modification given in FIG. 6. Further studies were made on the detailed conditions for assuring the advantageous effect of the magnetic roll 60. As a result, the undermentioned facts have been disclosed. The capacity of the magnetic roll 60 to eliminate the tailing, fogging and blurring of an impression transcribed on a copy sheet varies with the magnitude of a magnetic force involved and the condition in which the magnetic roll 60 is made to frictionally slide over the electrostatic latent image-forming plane 56 of the photosensitive drum 54. The above-mentioned satisfactory effects are prominently realized if the magnetic roll 60 is set near a developed region, particularly in that section of the electrostatic latent image-forming plane 56 of the photosensitive drum 54 which still undergoes the effect of a magnetic force resulting from the developing roll 36. As a result, it has been disclosed that the above-mentioned favorable effect can be fully realized by applying even such a low magnetic flux density as about 400 gauss. The above-mentioned advantageous effect is assumed to arise from the fact that the particles of the magnetic toner 40 are supposedly rolled over the electrostatic latent image-forming plane 56 of the photosensitive drum 54 due to the rotation of the magnetic roll 38, a component of the developing roll 36; and that while the particles of the magnetic toner 40 are thus rolled, namely, while the tailing phenomenon is actually taking place, the process by which the tailing phenomenon is brought about is eliminated. A developing apparatus shown in FIG. 6 is the type modified for improvement from the first embodiment of FIG. 5 on the basis of the above-mentioned assumption. In the modification of FIG. 6, therefore, the magnetic roll 60 is brought nearer to the developing region of the developing apparatus than in the first embodiment of FIG. 5.

Figure 7:
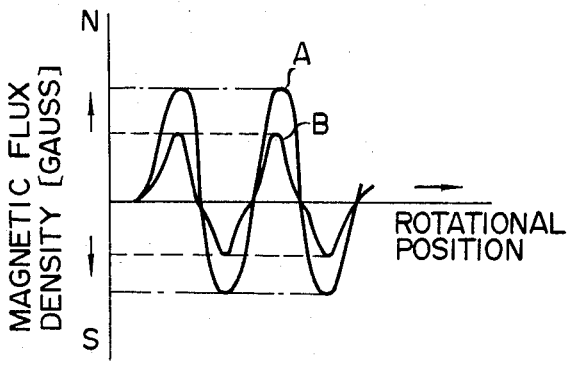
FIG. 7 is a curve diagram indicating the relationship between a magnetic flux density occurring in the magnetic roller of the developing apparatus of FIG. 6 and a magnetic flux density occurring in the cylindrical sleeve thereof.

The unnecessary particles 62 of the magnetic toner 40 which are adsorbed by the magnetic roll 60 are designed to be recovered to the peripheral surface of the cylindrical sleeve 42. To this end, therefore, a magnetic flux density A prevailing on the peripheral surface of the cylindrical sleeve 42 is chosen to have a greater magnitude than a magnetic flux density B produced on the peripheral surface of the magnetic roll 60 as illustrated in FIG. 7, and the magnetic roll 60 is chosen to be rotated clockwise of FIG. 6. Therefore, it has become unnecessary to provide the blade 64 for scraping off the unnecessary particles 62 of the magnetic toner 40 which are deposited on the magnetic roll 60 and the toner receptacle 66 for collecting the unnecessary toner particles 62, as is the case with the first embodiment of FIG. 5.

With the foregoing embodiment and modification, the magnetic roll 60 was used as a magnetic field generating means. To this end, however, it is possible to use a rod-or board-shaped magnetic member. This arrangement is accompanied with the inconvenience of periodically removing unnecessary toner particles 62, but assures the same tailing-suppressing effect as the magnetic roll 60.

When the magnetic roll 60 is used, no particular difference arises between the rotating directions of said magnetic roll 60, as considered from the above-mentioned tailing suppressing effect. It is better, therefore, to choose that rotating direction of the magnetic roll 60 which allows for the greater latitude of design.

Description will now be given with reference to FIG. 8 of a developing apparatus according to a second embodiment of this invention. The parts of the second embodiment the same as those of the first embodiment (including its modification) are denoted by the same numerals, description thereof being omitted.

Figure 8:
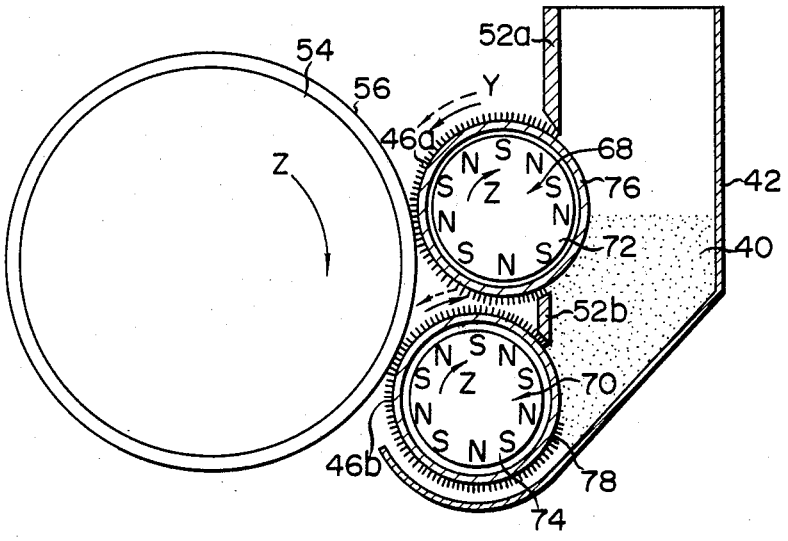
FIG. 8 is a cross sectional view of a developing apparatus according to a second embodiment of the invention.

Referring to FIG. 8, first and second developing rolls 68, 70 are set to face the electrostatic latent image-forming plane (developed plane) 56 of the photosensitive drum 54 in the order mentioned as counted in the clockwise rotating direction (indicated by the arrow Z) of the photosensitive drum 54. There first and second developing rolls 68, 70 are respectively formed of first and second magnetic rolls 72, 74 magnetized with a plurality of opposite polarities alternately arranged and first and second hollow cylindrical sleeves 76, 78 which are prepared from aluminium, or stainless steel or any other material and respectively arranged to surround the first and second magnet rolls 72, 74.

The magnetic toner 40 held in the toner hopper 42 to be used as a magnetic developing agent constitutes magnetic brushes **46*a*, 46*b* on the outer peripheral walls of the first and second developing rolls 68, 70, respectively. The magnetic brushes 46*a*, 46*b* have a thickness controlled by the corresponding first and second controlling members 52*a*, 52*b*. Both magnetic brushes 46*a*, 46*b* are made to frictionally slide over the electrostatic latent image-forming plane 56 of the photosensitive drum positioned on the left side of the first and second developing rolls 68, 70** and rotating clockwise in the direction of the indicated arrow Z, thereby developing twice an electrostatic latent image.

The first developing roll 68 for initially developing an electrostatic latent image causes the first magnet roll 72 to rotate clockwise in the direction of the indicated arrow Z at a speed of 800 to 1,000 r.p.m. and also the first hollow cylindrical sleeve 76 to rotate counterclockwise in the direction of the indicated arrow Y at a speed of 100 to 300 r.p.m. As a result, the magnetic toner 40 is conveyed counterclockwise in the direction of an indicated broken line arrow.

With the second developing roll 70 for developing the electrostatic latent image for the second time, the magnetic toner 40 is carried forward by the second magnetic roll 74 in such a direction as offsets the force with which the magnetic toner 40 is transported by the second cylindrical sleeve 78. In other words, the second magnetic roll 74 is rotated clockwise in the direction of the indicated arrow Z at a speed of 1,000 r.p.m., whereas the second cylindrical sleeve 78 is rotated similarly clockwise in the direction of the indicated arrow Z at a speed of several to 20 r.p.m. As a result, the magnetic toner 40 is conveyed counterclockwise in the direction of the indicated broken line arrow at a speed of about 100 to 30 mm/sec.

The second thickness controlling member **52*b* not only controls the thickness of the magnetic brush 46*b* formed on the second developing roll 70, but also plays the part of transporting the magnetic toner 40 from the second developing roll 70 to the first developing roll 68** when the amount of the magnetic toner 40 retained in the toner hopper 42 is reduced beyond a prescribed level.

An electrostatic latent image was developed under the above-mentioned condition with a gap of 0.4 mm allowed between the first developing roll 68 and the electrostatic latent image-forming plane 56 of the photosensitive drum 54 and a similar gap of 0.4 mm allowed between the second developing roll 70 and the electrostatic latent image-forming plane 56. It was possible using this embodiment to produce a copied impression of higher picture quality than was possible with a single developing roll. The copied impression was obviously free of the aforementioned tailing phenomenon, showing that the reproducibility of the fine lines of an original impression could be assured.

The above-mentioned favorable effect is assumed to arise from the fact that with the first developing roll 68, a main development process is carried out with a sufficiently high picture concentration due to the high travelling speed of the magnetic toner 40; with the second developing roll 70, the electrostatic latent image is developed with a low sensitivity due to the sufficiently slow traveling speed of the magnetic toner 40; and consequently, the second developing roll 70 concurrently acts to remove the unnecessary magnetic toner particles 62 which are excessively deposited during the first developing process to give rise to the occurrence of tailing. If the magnetic toner 40 is too fast conveyed by the second developing roll 70 then a copied impression will be accompanied with low picture density and tailing.

Further studies were made on the rotating direction and speed of the first and second developing rolls. As a result, the following conditions proved satisfactory in view of the aforementioned facts.

(1) The first developing roll 68 should be so arranged as to undertake the greater part of development (2) The second developing roll 70 should be so arranged as to control the reproducibility of the fine lines of an original impression.

The method of attaining the object of the above-mentioned item (1) is to cause the first cylindrical sleeve 76 and the first magnet roll 72 to be rotated in the opposite directions so as to assure the rapid supply of the magnetic toner 40. This process enables an impression to be copied with high density. It has been found that the method of attaining the object of the above-mentioned item (2) cannot be effectively realized by causing the second magnetic roll 74 and second cylindrical sleeve 78 to be rotated in a direction which offsets the traveling speed of the magnetic toner 40.

The second developing roll 70 must reproduce the fine low density lines of an original impression which failed to be reproduced by the first development process. To attain this object, it is best to reduce the force with which the magnetic brush **46*b* formed of the magnetic toner 40 deposited on the peripheral surface of the second cylindrical sleeve 78 frictionally slides over or acts on the electrostatic latent image-forming plane 56 of the photosensitive drum 54. In other words, it is preferred to allow a narrower space between the second thickness-controlling member 52*b* and second cylindrical sleeve 78 than between the first thickness-controlling member 52*a* and first cylindrical sleeve 76. It was experimentally found that when a space of 0.35 mm was allowed between the first thickness-controlling member 52*a* and first cylindrical sleeve 76, good results were realized by defining a space of 0.3 to 0.33 mm between the second thickness-controlling member 52*b* and second cylindrical sleeve 78**.

As described above, application of two developing rolls 68, 70 which are designed to perform different functions provides a novel developing apparatus which produces an impression on a copy sheet with such high picture quality as cannot be realized by the conventional single developing roll.

No reference was made to the conditions relative to the rotating direction of the photosensitive drum 54 and the position of the electrostatic latent image-forming plane on the drum 54. However, these conditions can be met simply by controlling the number of the rotations of the magnetic rolls 72, 74 and cylindrical sleeves 76, 78 and also the spaces between the thickness-controlling members **52*a*, 52*b* and cylindrical sleeve 76, 78**. Therefore, no noticeable problems are raised.

A developing apparatus according to the second embodiment comprises, as described above, first and second developing rolls on each of which a magnetic brush consisting of a magnetic developing agent is formed. Therefore the electrostatic latent image produced on the electrostatic latent image forming plane 56 of the photosensitive drum 54 is developed twice. In this case, the first developing roll for performing a first development causes the first cylindrical sleeve and first magnetic roll to be rotated in the opposite directions, and the second developing roll for carrying out a second development causes the second cylindrical sleeve and second magnetic roll to be rotated in the same direction. Consequently, the second embodiment, through of simple arrangement, has the advantages of suppressing the occurrence of tailing and producing a distinct impression on a copy sheet with the high reproducibility of the fine lines of the original impression.

There will now be described with reference to FIG. 9 a developing apparatus according to a third embodiment of this invention. A first developing roll 80 is set to face the electrostatic latent image-forming place (developed place) 56 of the photosensitive drum 54. The first developing roll 80 comprise a first magnetic roll 82 on which a plurality of opposite polarities are alternately arranged and a first cylindrical sleeve 84 which surrounds the first magnetic roll 82. The first magnetic roll 82 is rotated clockwise in the direction of the indicated arrow Z, and the first cylindrical sleeve 84 is rotated counterclockwise in the direction of the indicated arrow Y. The magnetic toner 46 which is delivered from a first toner hopper **42*a* to be used as a magnetic developing agent constitutes a magnetic brush 46*a* on the outer circumferential surface of the first cylindrical sleeve 84. This magnetic brush 46*a* has its thickness controlled by a first doctor blade 52*a*. The magnetic brush 46*a* is arranged to frictionally slide over the electrostatic latent image-forming plane 56 of the photosensitive drum 54 which is set on the left side of the first developing roll 80 and rotated clockwise in the direction of the indicated arrow Z. When successively set to face charging means and electrostatic latent image-forming means (neither shown) which are arranged up stream of the clockwise rotating direction of the photosensitive drum 54, the electrostatic latent image previously produced on the electrostatic latent image-forming plane 56 (developed plane) of the photosensitive drum 54 is developed by being rubbed by the magnetic brush 46*a*. The development by only the first developing roll 80** has the drawbacks that a developed image is accompanied with the tailing phenomenon and the fine lines of an original impression having a low density are transcribed on a copy sheet with low reproducibility.

When the magnetic toner 40 has an electric resistance of $10^{12}$ to $10^{12}$ Ω·cm (when a voltage is impressed at the rate of 1,000 v/min) and the particles of the magnetic toner 40 have an average size of 10 to 15 microns, then it is most preferred that the first magnet roll 82 be rotated at a speed of 600 to 1,200 r.p.m., and the first cylindrical sleeve 84 be rotated at a speed of 150 to 300 r.p.m., and that a space between the first cylindrical sleeve 84 and the electrostatic latent image-forming plane 56 of the photosensitive drum 54 be chosen to be smaller than 0.5 mm. The rate at which the magnetic toner 40 is supplied to the peripheral wall of the first cylindrical sleeve 84 has to be varied with the width of the space.

To eliminate the aforementioned drawbacks of the first developing roll 80, a second developing roll 86 is provided below the first developing roll 80, namely, downstream of the clockwise rotating direction of the electrostatic latent image-forming plane 56 of the photosensitive drum 54 in a state facing that section of the electrostatic latent image-forming plane 56 of the photosensitive drum 54 which was previously developed by the first developing roll 80.

The second developing roll 86 comprises a stationary magnet roll 88 having a plurality of alternately arranged opposite polarities and a second cylindrical sleeve 90 surrounding the stationary magnetic roll 88. The second cylindrical sleeve 90 is rotated counterclockwise in the direction of the indicated arrow Y, causing the magnetic toner 40 supplied from the second toner hopper **42*b* to form the magnetic brush 46*b* on the outer peripheral wall of the second cylindrical sleeve 90. Thus, development is carried out again of the electrostatic latent image-forming plane 56 of the photosensitive drum 54 which was previously developed by the first developing roll 80**, thereby improving the picture quality of an impression to be finally transcribed on a copy sheet.

The second cylindrical sleeve 90 is spaced 0.3 to 1.0 mm from the electrostatic latent image-forming plane 56 of the photosensitive drum 54 and is rotated at a slow speed of several to 50 r.p.m. Consequently, those particles of the magnetic toner which produced the tailing phenomenon at the time of the first development by the first developing roll 80 are adsorptively removed by the alternately arranged opposite magnetic poles of the stationary magnetic roll 88. Further, the magnetic brush **46*b* formed of the magnetic toner 40 which frictionally slides over the electrostatic latent image-forming plane 56 of the photosensitive drum 54 assures the high reproducibility of the low density fine lines (indicated by numeral 32 of FIG. 4) of an original impression extending crosswise of the traveling direction of a copy sheet. Since the first developing roll 80 causes the magnetic toner 40 to be deposited on the electrostatic latent image-forming plane 56 of the photosensitive drum 54 with a low adhesivity (a low Coulomb force is applied due to the extinction of an electrostatic latent image by exposure to light), it is possible to easily remove not only the tailing phenomenon but also the scattering and blurring of the magnetic toner which took place at the time of the first development, when development is carried out again by the second developing roll 86. Accordingly, the developing apparatus of FIG. 9** according to the third embodiment of this invention enables a twice developed electrostatic latent image to provide a copied impression with a high picture quality which has not been obtainable with conventional developing apparatus.

It will be noted that the second developing roll 86 should be operated under such a condition as compensates for the defective picture quality resulting from the first developing process. Therefore, this object cannot be most satisfactorily attained merely by applying the operating condition of the conventional developing apparatus to the second developing roll 86.

Figure 9:
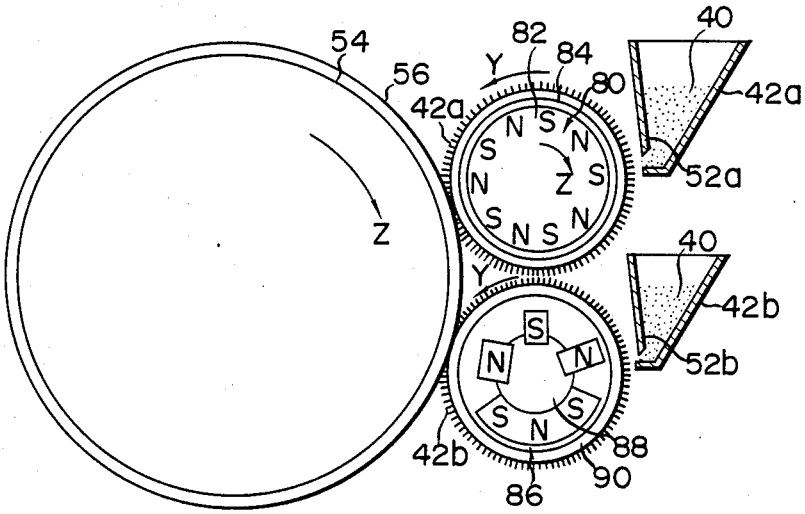
FIG. 9 is a cross sectional view of a developing apparatus according to a third embodiment of the invention.

An important difference between the conventional developing apparatus and that of FIG. 9 according to the third embodiment of this invention is that with the second developing roll 86 of said third embodiment, a magnetic brush **46*b* is made to frictionally slide over the electrostatic latent image-forming plane 56 of the photosensitive drum 54 with a lighter touch, and further the cylindrical sleeve 90 is rotated at a lower speed than in the conventional developing apparatus comprising a single developing roll. The above-mentioned conditions could hardly be thought of in the conventional developing apparatus using a single developing roll. When the magnetic poles of the second developing roll 86 are chosen to have a sufficiently higher magnetic flux density than 1,000 gauss, it has been experimentally proven that even when the magnetic brush 46*b* is not made to contact the electrostatic latent image-forming plane 56 of the photosensitive drum 54, it is possible to suppress the tailing phenomenon and the blurring and fogging of a developed impression which result from the operation of the first developing roll 80**.

Figure 11:
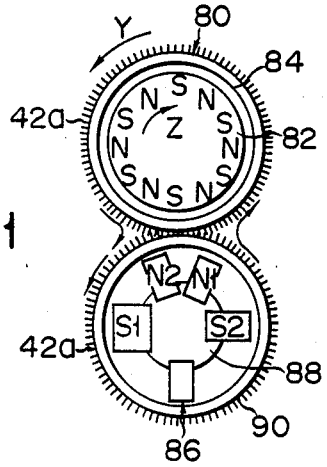
FIG. 11 is a cross sectional view of a second modification of said third embodiment.
Figure 10:
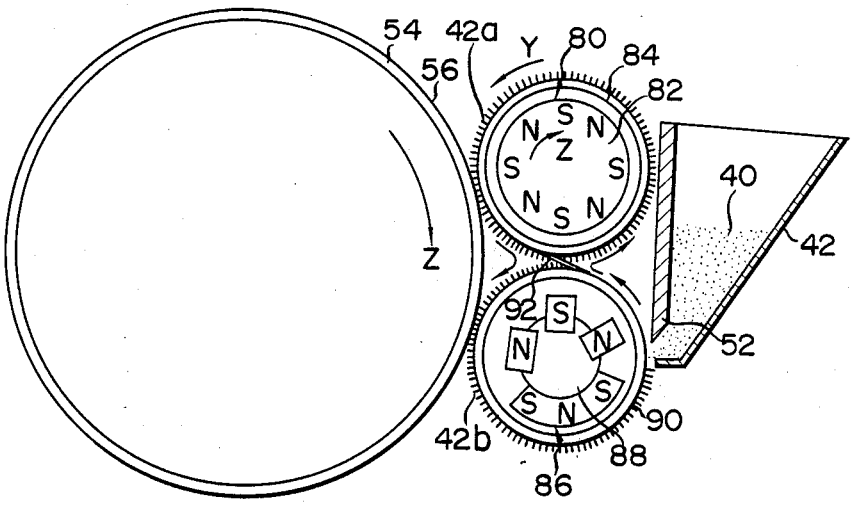
FIG. 10 is a cross sectional view of a first modification of said third embodiment.

The developing apparatus of FIG. 9 according to the third embodiment of this invention comprised the toner hoppers **42*a*, 42*b* corresponding to the first and second developing rolls 80, 86. To eliminate, however, the inconvenience of providing separate toner hoppers, it is possible to provide a single toner hopper 42 for supplying the magnetic toner 40 only to the peripheral wall of the second cylindrical sleeve 90 of the second magnetic roll 86, as illustrated in FIG. 10 as a first modification of the third embodiment. In the case of this modification, a separator 92 is provided between the first developing roll 80 and second developing roll 86, causing the magnetic toner 40 supplied to the second developing roll 86 to be conveyed to the first developing roll 80. The application of the separator 92 enables the magnetic toner 40 to the circulated through a space defined by the two developing rolls 80, 86. Further, it is possible to omit the separator 92 by causing, as shown in FIG. 11, as a second modification of the third embodiment, a given magnet pole, for example $N_1$ of the second magnetic roll 88 included in the second magnetic roll 86 to have a lower magnetic force than that of the magnetic roll 82 of the first developing roll 80. Thus the magnetic toner 40 is conveyed to the first developing roll 80 by a difference between two magnetic forces. Further, when the magnetic pole $N_2$ of the second magnetic roll 88 included in the second magnetic roll 86 is chosen to have a greater magnetic force than the first magnetic roll 82, then the magnetic toner 40 is carried backward from the first developing roll 80 to the second developing roll 86. The above-mentioned process assures the smooth transportation of the magnetic toner 40**.

As described above, two developing rolls 80, 86 involved in the developing apparatus of this invention are so arranged to have different developing characteristics, thereby enabling said developing apparatus to exhibit such a prominent effect as is impossible with the conventional developing apparatus.

It will be noted that this invention is not limited to the arrangement of the aforegoing embodiments; the arrangement of the plural magnetic poles of the first and second magnet rolls 82, 86 need not be limited to that already described, but may be suitably changed as need arises; and the rotating direction and speed of the magnetic roll and cylindrical sleeve are free to be changed within the range allowed by the picture quality of an impression to be transcribed on a copy sheet. The point is that the first development is carried out by the rotation of the first magnetic roll 82 and that of the second cylindrical sleeve 84 and undertake the second development by the second cylindrical sleeve 90 alone, thereby improving the picture quality of an impression to be transcribed on a copy sheet. It will be seen from the above-mentioned object that exactly the same invention as that proposed herein will result if the developing rolls are increased in number, and yet the final development is undertaken by a stationary magnetic roll.

What is claimed is:

1. A developing apparatus which is designed to develop an electrostatic latent image produced on an electrostatic latent image-forming surface of an image carrier rotating in one direction through a developing region of said image carrier, said developing effected by depositing a magnetic developing agent onto said surface, said apparatus comprising:

first means for generating a rotating magnetic field, said first means being set to face said developing region to supply said developing agent to that portion of the electrostatic latent image-forming surface of said image carrier which has rotated to within said developing region; and second means generating a magnetic field, said second means being provided downstream of the rotating direction of said image carrier, spaced apart therefrom and not in contact therewith, and opposing a region where the unnecessary particles of said magnetic developing agent which are deposited on that portion of the image carrier on which said electrostatic latent image has been developed by the first means roll over the electrostatic latent image-forming surface under the effect of the prescribed rotating magnetic field generated by the first means, said second means for generating a magnetic field the strength of which is set to be high enough to remove the rolling unnecessary particles of said magnetic developing agent from the surface of the image carrier.

2. The developing apparatus according to claim 1, wherein said first means includes:

a hopper for holding the magnetic developing agent; and at least one developing roll including a first magnetic roll which is provided with a plurality of magnetic poles defining a prescribed strength of a magnetic field and is rotated in one direction, and a first cylindrical sleeve which surrounds the first magnetic roll, and is partly contacted with the magnetic developing agent held in said hopper and is rotated in either direction whereby the magnetic developing agent is carried over said first cylindrical sleeve in said other direction toward the developing region, while temporarily constructing a magnetic brush.

3. The developing apparatus according to claim 2, wherein said second means is set in a region where the unnecessary particles of the magnetic developing agent roll over the electrostatic latent image-forming surface under the effect of a prescribed magnetic field created by the developing roll.

4. The developing apparatus according to claim 3, wherein the second means is provided with a magnet having a plurality of magnetic poles.

5. The developing apparatus according to claim 4, wherein said magnet is rotated, and generates a prescribed magnetic flux density lower than that of the developing roll.

6. An apparatus comprising;

means for defining a surface;

means for moving said surface in a first direction from at least a first position to a second position;

means for forming an electrostatic image on said surface;

means for storing a quantity of magnetic developing agent;

first magnetic field generating means for generating a first alternating magnetic field in proximity to said surface, said first magnetic field removing agent from said storing means and depositing said removed agent onto said surface, a first portion of said deposited agent adhering to said electrostatic image, a second portion of said deposited agent moving along said surface under the force of said first field; and second magnetic field generating means, displaced from said first generating means in said first direction and not contacting said surface, for generating a second magnetic field, in proximity to said surface to oppose a region thereof where unnecessary particles of said magnetic developing agent which are deposited on that portion of said surface on which said electrostatic latent image has been developed by said forming means roll over said surface under the effect of said first magnetic field generated by the first magnetic field means, said second magnetic field having a flux density great enough to directly attract and remove the second, moving portion of said deposited agent from said surface but small enough to leave the first portion of said deposited agent adhered to said image.

7. An apparatus as in claim 6 wherein said first magnetic field generating means includes:

a first rotatable cylindrical roller including means for defining a plurality of alternating magnetic poles about the circumference thereof;

a first cylindrical sleeve, rotatably journaled to said first roller;

means for rotating said first roller; and means for rotating said first sleeve independently of the rotation of said first roller.

8. An apparatus as in claim 7 wherein:

said means for rotating said first roller includes means for rotating said roller in a first direction at a first angular velocity; and said means for rotating said first sleeve includes means for rotating said sleeve in a second direction opposite to said first direction at a second velocity different from said first velocity.

9. An apparatus as in claim 8 wherein:

said second magnetic field generating means includes:

a second rotatable cylindrical magnetic roller including means for defining a plurality of alternating magnetic poles about the circumference thereof, and means for rotating said second roller; and said first and second rollers simultaneously apply said first and second magnetic fields, respectively, to the same area of said surface.

10. An apparatus as in claim 9 wherein said second roller is disposed a distance from said surface within the range of 0.3 to 1.0 mm.

11. An apparatus as in claim 9 wherein the magnetic flux density of said second field is within the range of 600 to 1000 gauss.

12. An apparatus for developing an electrostatic latent image formed on a surface of an image carrier, said surface rotating in a first direction of rotation from a first position to at least a second position, said apparatus comprising:

means for storing a quantity of magnetic developing agent;

first magnetic field generating means for generating a first alternating magnetic field in proximity to said surface, said first magnetic field removing agent from said storing means and depositing said removed agent onto said surface, a first portion of said deposited agent adhering to an electrostatic image formed on said surface, a second portion of said deposited agent moving along said surface under the force of said first field; and second magnetic field generating means, displaced from said first generating means in said first direction of rotation and not contacting said surface, for generating a second magnetic field, in proximity to said surface in a location opposing a region where unnecessary particles of said magnetic developing agent which are deposited on that portion of said surface on which said electrostatic latent image has been developed by the first magnetic field means roll over said surface under the effect of said first magnetic field, said second magnetic field having a flux density great enough to directly attract and remove said second, moving portion of said deposited agent from said surface but small enough to leave the first portion of said deposited agent adhered to said image.

13. An apparatus as in claim 12 wherein:

said first magnetic field generating means includes a first rotatable cylindrical magnetic roller including means for defining a first plurality of alternating magnetic poles about the circumference thereof;

said second magnetic field generating means includes a second rotatable cylindrical magnetic roller including means for defining a second plurality of alternating magnetic poles about the circumference thereof; and said apparatus further comprises:

means for rotating said first roller, and means for rotating said second roller.

14. A method of producing an image comprising the steps of:

(1) forming an electrostatic image on a surface;

(2) continuously moving said surface;

(3) generating a first alternating magnetic field in proximity to said surface;

(4) applying magnetic developing agent to said moving surface under the force of said first field generated by said field generating step (3), a first portion of said applied agent adhering in a layer of a substantially predetermined thickness to said electrostatic image formed by said image forming step (1), a second portion of said applied agent adhering to areas of said surface other than the areas of on which said image is formed, a third portion of said applied agent adhering to said layer;

(5) producing a second alternating magnetic field in proximity to said surface at a location which opposes a region where unnecessary particles of said magnetic developing agent which are deposited on that portion of said surface on which said electrostatic latent image has been formed roll over said surface under the effect of said first alternating magnetic field;

(6) moving said second and third portions of said applied agent over said surface under the force of said first field generated by said generating step (3);

(7) removing said moving second and third portions of said agent from said surface directly under the force of said second field produced by said field producing step (5); and (8) transferring said first portion of said agent from said surface to a medium.

15. A method as in claim 14 wherein:

said first field generating step (3) comprises the step of rotating a first rotatable cylindrical magnetic roller, said first roller including means for defining a plurality of alternating magnetic poles about the circumference thereof; and said second field generating step (5) comprises the step of rotating a second rotatable cylindrical magnetic roller, said second roller including means for defining a plurality of alternating magnetic poles about the circumference thereof.

* * * * *